US005937543A

United States Patent [19]

Hall et al.

[11] Patent Number: 5,937,543

[45] Date of Patent: Aug. 17, 1999

[54] FOOTWEAR HAVING A VARIABLE SIZED INTERIOR

[75] Inventors: Robert W. Hall, Acushnet; Cleveland A. Heath, Medfield; Alison B. Mack, Framingham, all of Mass.; Roger T. Neiley, Danbury, Conn.

[73] Assignee: The United States of America as represented by the Secretary of the Navy, Washington, D.C.

[21] Appl. No.: 08/919,072

[22] Filed: Aug. 22, 1997

[51] Int. Cl.[6] ..... A43B 3/10; A43B 3/26

[52] U.S. Cl. ..... 36/10

[58] Field of Search ..... 36/10, 55, 7.1 R, 36/93, 97

[56] References Cited

U.S. PATENT DOCUMENTS

| | | | |
|---|---|---|---|
| 4,302,889 | 12/1981 | Negrin | 36/10 X |
| 4,538,368 | 9/1985 | Mugford | 36/7.1 R X |
| 4,575,954 | 3/1986 | Bye | 36/89 |
| 4,736,531 | 4/1988 | Richard | 36/55 X |
| 4,813,668 | 3/1989 | Solloway | 36/105 X |
| 5,259,126 | 11/1993 | Rosen | 36/55 X |

*Primary Examiner*—B. Dayoan

*Attorney, Agent, or Firm*—Michael J. McGowan; Prithvi C. Lall; Michael F. Oglo

[57] ABSTRACT

A variable size footwear includes a sole, an upper fixed to the sole and an insole overlying the sole within the upper. An inner sock of elastic material is fixed to the sole and/or insole. The sock in an unstressed state is smaller than the upper, but is expandable to a size conforming to interior walls of the upper. The sock is fixed at an upper edge thereof to the upper.

8 Claims, 2 Drawing Sheets

FOOTWEAR HAVING A VARIABLE SIZED INTERIOR

STATEMENT OF GOVERNMENT INTEREST

The invention described herein may be manufactured and used by or for the Government of the United States of America for government purposes without the payment of royalties thereon or therefor.

BACKGROUND OF THE INVENTION (1) Field of the Invention

This invention relates to footwear, and is directed more particularly to boots of the type worn by firefighters and marine damage control personnel.

(2) Description of the Prior Art

Firefighters' boots currently are available only in full sizes. The boots typically are quite rigid as a result of the boot materials necessary to provide a level of protection required by governing standards. Thus, firefighter's boots have a limited range of fit and are generally uncomfortable.

Onboard ship, particularly in the U.S. Navy, because of space limitations and other considerations, issuance of personal firefighters' boots is not practical. Boots are stored in a damage control locker, or the like, and are taken on a first-come, first-serve basis. Usually, the boots are limited to larger sizes, such as sizes 10 and 12, to accommodate all responders. In the event of a fire, shipboard firefighters don the boots, usually without time to make a selection with regard to comfort. The result is that the wearers often are wearing improperly sized boots during a firefighting exercise. In most cases, the boot fit is loose, resulting in discomfort and reduced mobility, and is of excess weight.

A recent comprehensive field test and evaluation of firefighter procedures and equipment identified poor fit and heavy weight of footwear as notable deficiencies.

There is thus a need for a firefighter's boot which will enhance comfort, mobility and safety, and thereby improve the wearer's ability to perform the firefighting mission.

SUMMARY OF THE INVENTION

An object of the invention is, therefore, to provide footwear for use by firefighters, and particularly by firefighters required to use "common property" boots, which is of a variable size and therefore adapted to fit a range of different sized feet.

A further object of the invention is to provide a boot which is more comfortable to the user than the currently used boots.

With the above and other objects in view, as will hereinafter appear, a feature of the present invention is the provision of variable size footwear comprising a conventional outer boot sole and an upper fixed to the sole. The boot further comprises an inner sock, or inner boot, of elastic material fixed within the outer boot. The inner sock in an unstressed state is smaller than the upper, but is expandable to a size conforming to interior walls of the upper.

The above and other features of the invention, including various novel details of construction and combinations of parts, will now be more particularly described with reference to the accompanying drawings and pointed out in the claims. It will be understood that the particular boot embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 2:
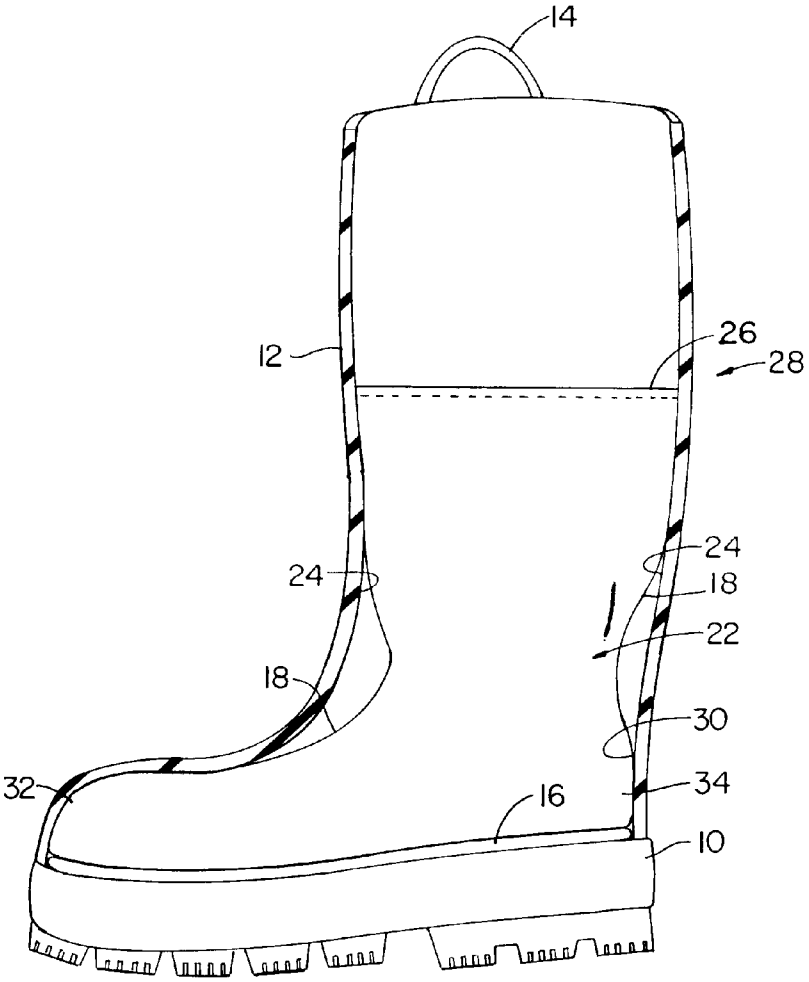
FIG. 2 is a centerline sectional view of the boot of FIG. 1.
Figure 1:
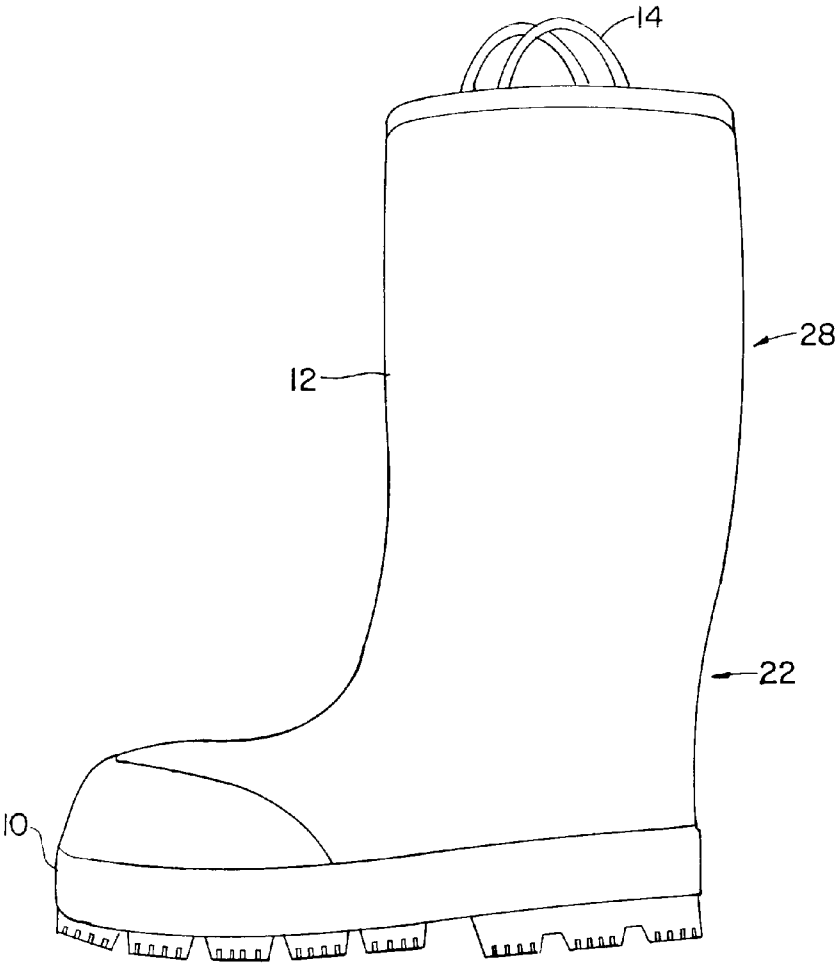
FIG. 1 is a side elevational view of one form of boot illustrative of an embodiment of the invention.

Referring to FIGS. 1 and 2, it will be seen that the illustrative boot includes an outer sole 10 fixed to an upper 12, preferably having boot pulls 14 thereon. An insole 16 overlies outer sole 10 within upper 12.

Figure 3:
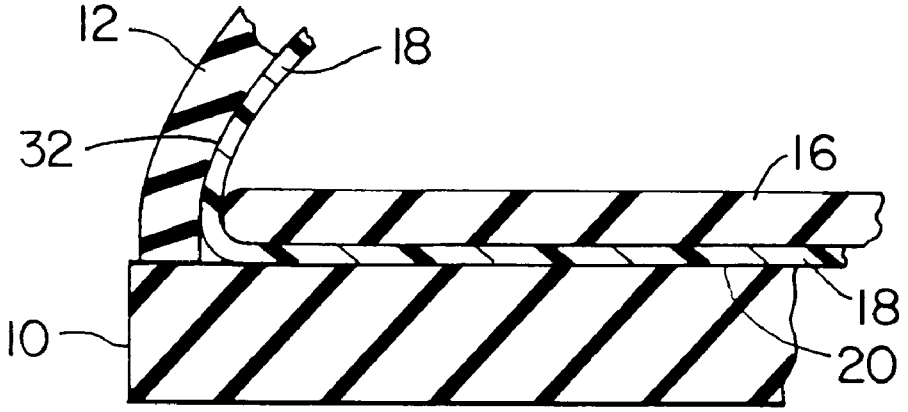
FIG. 3 is an enlarged sectional view of a portion of the boot of FIG. 2.

Referring to FIG. 3, it will be seen that an inner sock 18 is disposed between outer sole 10 and insole 16 and is fixed, as by adhesive, to outer sole 10. The insole 16 is fixed in sock 18 as by adhesive, to a sole portion 20 of inner sock 18.

Figure 4:
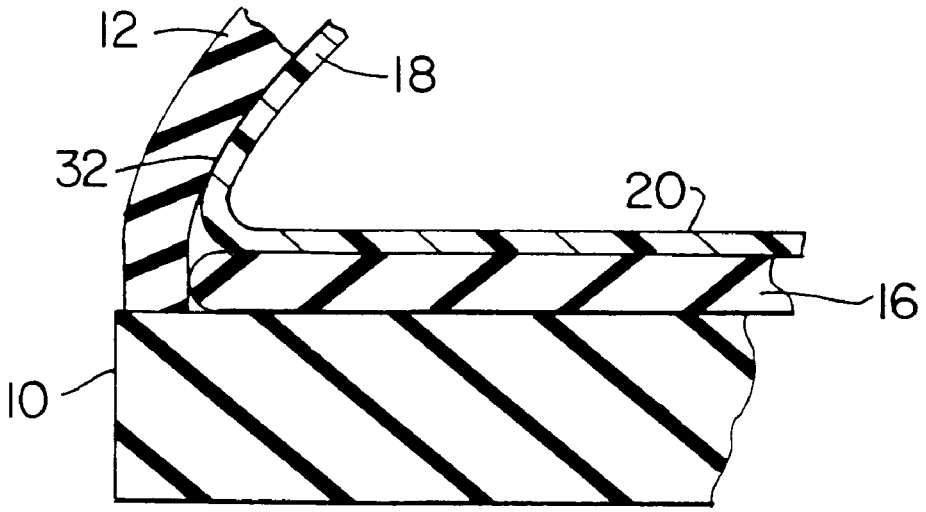
FIG. 4 is similar to FIG. 3 but illustrative of an alternative embodiment.

Alternatively, as shown in FIG. 4, insole 16 may be fixed to outer sole 10, and sock 18 fixed to insole 16.

The inner sock 18 is of elastic material, such as fabric, foam, elastomeric film, and webbing of either fabric or elastomeric material, or a combination thereof. An elastic material found appropriate is Neoprene, which is a closed cell elastomeric foam material. However, any elasticized material capable of performing the passive size adjustment task is appropriate.

In an unstressed state, as shown in FIGS. 1 and 2, inner sock 18 is smaller than upper 12 but is expandable to a size conforming to interior walls 24 of upper 12. The inner sock 18 is fixed at an upper edge 26 thereof to the walls 24 of the upper 12 in a calf area 28 of upper 12. The sock 18 is adapted, by virtue of its elasticity, to urge a foot (not shown) disposed therein against an inside heel area 30 of the boot as well as other areas of the foot, such as across the instep.

As noted above, the inner sock 18 preferably is of elastic material. Alternatively, inner sock 18 is in part of elastic material which extends from toe 32 to heel 34 of sock 18, and from proximate ankle area 22 to proximate sock sole portion 20.

In use, a firefighter, such as a member of a shipboard damage control team, selects a pair of boots having a size which includes the firefighter's size. For example, a firefighter normally wearing a 9½ size shoe, would select a size designated for sizes 8 to 10 boot. The inner sock is normally of a size substantially less than the boot size, as for example, size 8, but expandable to the boot size, such as size 10. The entry of the firefighter's size 9½ foot into the size 8 inner sock causes the inner sock to expand to contours to the foot, providing support to the 9½ size foot in the size 10 boot.

There is thus provided a boot which accepts multiple foot sizes and which provides support and comfort to the foot. The boot provides passive size adjustment, such that the wearer need not actively adjust anything after donning the boot. The boot herein described provides an air barrier between the inner sock 18 and upper 12 which enhances insulation of the foot. The improved insulation permits reduction of insulative materials and therefore reduction of bulk and weight. The secure fit provided by the improved boot affords the benefits of improved safety, increased mobility, and reduced fatigue.

An additional advantage realized by the boot described herein lies in the reduction of volume subject to flooding, so that in the event water spills into the inner sock, less water, and therefore less weight, enters the boot.

It is to be understood that the present invention is by no means limited to the particular construction herein disclosed and/or shown in the drawings, but also comprises any modifications or equivalents within the scope of the claims. For example, while the passive fit adjustment is shown and described herein in conjunction with a firefighter's boot, and while the invention finds significant utility in such footwear, it will be apparent that the invention is readily adapted for use in other kinds of footwear, particularly in various sports. It will be further apparent that the concept herein is applicable to other clothing items, such as handwear and headwear.

What is claimed is:

1. A variable size boot comprising:

a sole;

an upper fixed to said sole;

an insole overlying said sole within said upper; and an inner sock of elastic material fixed to a selected one of said sole and said insole, said inner sock in an unstressed state being smaller than said upper but expandable to a size conforming to an interior wall of said upper, said inner sock being fixed at an upper edge thereof to walls of said upper in a calf area of said upper spaced from an ankle area of said upper and spaced from a top of said upper, said inner sock being configured to receive an entire foot, ankle, and at least a portion of the calf of a wearer.

2. The boot according to claim 1 wherein said inner sock is fixed to said sole and said insole is disposed in said sock.

3. The boot according to claim 1 wherein said insole is fixed to said sole and said sock is fixed to said insole.

4. The boot according to claim 1 wherein said elastic material comprises a selected one of fabric and elastomeric film.

5. The boot according to claim 1 wherein said elastic material comprises a closed cell elastic foam.

6. The boot according to claim 5 wherein said closed cell elastic foam comprises Neoprene.

7. The boot according to claim 1 wherein said sock is adapted to urge a foot disposed in said boot against an inside heel area of said boot.

8. The boot according to claim 1 wherein said inner sock is only in part of said elastic material, and said part which is of elastic material extends from toe to heel and from proximate an ankle area to proximate a sole area.

* * * * *